United States Patent [19]

Kleefeldt et al.

[11] Patent Number: 4,974,886

[45] Date of Patent: Dec. 4, 1990

[54] MOTOR-VEHICLE DOOR LATCH WITH ANTITHEFT OVERRIDE

[75] Inventors: Frank Kleefeldt, Heiligenhaus; Johannes T. Menke, Velbert, both of Fed. Rep. of Germany

[73] Assignee: Kiekert GmbH & Co. Kommanditgesellschaft, Heiligenhaus, Fed. Rep. of Germany

[21] Appl. No.: 389,652

[22] Filed: Aug. 4, 1989

[30] Foreign Application Priority Data

Aug. 13, 1988 [DE] Fed. Rep. of Germany ..... 3827611
Jan. 31, 1989 [DE] Fed. Rep. of Germany ..... 3902776

[51] Int. Cl.[5] ..... E05C 3/06

[52] U.S. Cl. ..... 292/201; 292/216; 70/264

[58] Field of Search ..... 70/264, 262, 263, 265; 292/216, 201

[56] References Cited

U.S. PATENT DOCUMENTS 4,304,249 12/1982 Kleefeldt ..... 70/264
4,342,209 8/1982 Kleefeldt ..... 70/264
4,440,006 4/1984 Kleefeldt ..... 70/264

FOREIGN PATENT DOCUMENTS 3443287 6/1986 Fed. Rep. of Germany .

*Primary Examiner*—Robert L. Wolfe

*Attorney, Agent, or Firm*—Herbert Dubno; Andrew Wilford

[57] ABSTRACT

A motor-vehicle door latch for use on a vehicle door having inside and outside handles and inside and outside locking elements has a housing, a latch fork pivotal on the housing and engageable in a locking position with a door bolt to retain same and lock the door, inside and outside operating levers pivoted on the housing and connected to the respective handles, and inside and outside locking levers pivoted on the housing and connected to the respective locking elements. An actuating lever operatively engageable with the fork can release same from the locking position and a link coupled to the locking levers is displaceable thereby between a position coupling the outside operating lever to the actuating lever for displacement of the fork out of the locking position by actuation of the outside operating lever and a position decoupling the outside operating lever from the actuating lever. Thus in the decoupling position actuation of the outside operating lever will not unlock the door. A central actuating unit has motor whose spindle carrier a nut that can move an antitheft lever into an antitheft position. Mechanism connected between the antitheft lever, the inside levers, and the link decouples the inside levers from the actuating lever in the antitheft position of the antitheft lever. Thus in the antitheft position actuation of the inside operating lever will not be able to release the fork and actuation of the inside locking lever will not unlock the door.

9 Claims, 6 Drawing Sheets

MOTOR-VEHICLE DOOR LATCH WITH ANTITHEFT OVERRIDE

FIELD OF THE INVENTION

The present invention relates to a motor-vehicle door latch. More particularly this invention concerns such a latch provided with an antitheft feature.

BACKGROUND OF THE INVENTION

A standard door latch for a motor vehicle includes a housing mounted on the door edge and formed with a recess into which is engageable a bolt projecting from the respective door post. A fork is pivotal in the housing between a latching position engaging around the bolt and holding it solidly in the recess and a freeing position permitting the bolt to enter and leave the recess. A latch pawl engageable with the fork can hold it in the latched position. The latch pawl in turn is typically spring loaded and can be controlled via appropriate levers both from an inside door handle and an outside door handle, either of which can therefore operate the latch to allow the door to be opened.

In addition the door can be locked by means of a button or lever inside the door and a key cylinder outside the door, and also frequently by an actuator operated by a central lock system. When locked the outside door handle is either impeded from moving so it cannot move the latch pawl, or it is decoupled from the latch pawl so its actuation is ineffective.

In a standard lock system the inner door handle and inner lock button or lever remain effective even when the door is locked so that the outside handle does not work. In an antitheft system, however, there is, in addition to the locked and unlocked conditions of the latch, an antitheft mode or position in which the latch cannot be opened by either of the door handles and in which the inside lock element is also ineffective to unlock the door. Thus when in the antitheft position a would-be thief cannot even open the door by forcing the window and operating the door from inside.

As described in U.S. Pat. Nos. 4,342,209 of F. Kleefeldt and 4,669,283 of J. Ingehoven the antitheft position is set by an electric-motor actuator having a motor whose output shaft is a spindle on which is threaded a nut that acts as a detent that physically impedes and latches the inside lock element in the locked position. Thus the structure must be strong enough to withstand whatever force the would-be thief is willing to apply. Hence the elements must be made fairly robust and, therefore, are of expensive manufacture.

Another substantial disadvantage of the known antitheft systems is that the antitheft position is set by an actuator, typically an electric motor, and the latch can only be reset out of this antitheft position by means of this motor. Thus if the vehicle's electric power fails it becomes fairly impossible to enter the vehicle, even for someone with the right key that typically can operate the main central-lock switch. Similarly if the connection to a one of the latch actuators fails or one of the electric motors burns out, the respective latch can be left stuck in the antitheft position and painstaking disassembly of the door is required to effect the necessary repair.

OBJECTS OF THE INVENTION

It is therefore an object of the present invention to provide an improved antitheft-type motor-vehicle door latch.

Another object is the provision of such an improved antitheft-type motor-vehicle door latch which overcomes the above-given disadvantages, that is which is of simple and inexpensive construction and that can readily be reset from the antitheft position even when the electric power fails or the respective actuator no longer operates.

SUMMARY OF THE INVENTION

A motor-vehicle door latch for use on a vehicle door having inside and outside handles and inside and outside locking elements has according to the invention a housing, a latch fork pivotal on the housing and engageable in a locking position with a door bolt to retain same and lock the door, inside and outside operating levers pivoted on the housing and connected to the respective handles, and inside and outside locking levers pivoted on the housing and connected to the respective locking elements. An actuating lever operatively engageable with the fork can release same from the locking position and a link coupled to the locking levers is displaceable thereby between a position coupling the outside operating lever to the actuating lever for displacement of the fork out of the locking position by actuation of the outside operating lever and a position decoupling the outside operating lever from the actuating lever. Thus in the decoupling position actuation of the outside operating lever will not unlock the door. A central actuating unit has motor whose spindle carries a nut that can move an antitheft lever into an antitheft position. Mechanism connected between the antitheft lever, the inside levers, and the link decouples the inside levers from the actuating lever in the antitheft position of the antitheft lever. Thus in the antitheft position actuation of the inside operating lever will not be able to release the fork and actuation of the inside locking lever will not unlock the door.

With the system of this invention, therefore, in the antitheft position the inside levers are not blocked from operating to prevent the door from being opened, for instance by someone who has broken the window, but instead they are merely decoupled from the latch mechanism. Thus the inside operating and locking elements can be actuated but they will not do anything. As a result it is not necessary to make the actuator very robust to resist such forced entry, making the latch simpler and cheaper to build.

According to a feature of this invention the antitheft lever is provided with a formation engageable with the link to retain same in the decoupling position in the antitheft position of the antitheft lever. In addition the link includes a pin, the outside operating lever being formed with an elongated slot through which the pin projects, the formation of the antitheft lever being an abutment engageable with the pin.

In accordance with yet another feature of this invention the antitheft lever and outside lever are provided with interengageable override formations and the outside locking lever is displaceable into an override position engaging the override formations together and pulling the abutment of the antitheft lever out of engagement with the pin. Thus even if the actuator fails or the car battery is dead, it is possible to manually open the latch from the antitheft position.

Further more in accordance with this invention the inside locking lever has a pair of separately pivoted but interengaged parts. The latch further comprises a spring coupling one of the parts to the link for joint pivoting and a toggle spring connected between the housing and the one part to retain same in each of two end positions. By appropriately relatively dimensioning the springs it is possible for the system to provide a visible indication of a forced overriding of the antitheft position in that the inside lock element will remain in the open position if pulled into it in the antitheft position of the latch.

DESCRIPTION OF THE DRAWING

The above and other objects, features, and advantages will become more readily apparent from the following, reference being made to the accompanying drawing in which.

SPECIFIC DESCRIPTION

Figure 1:
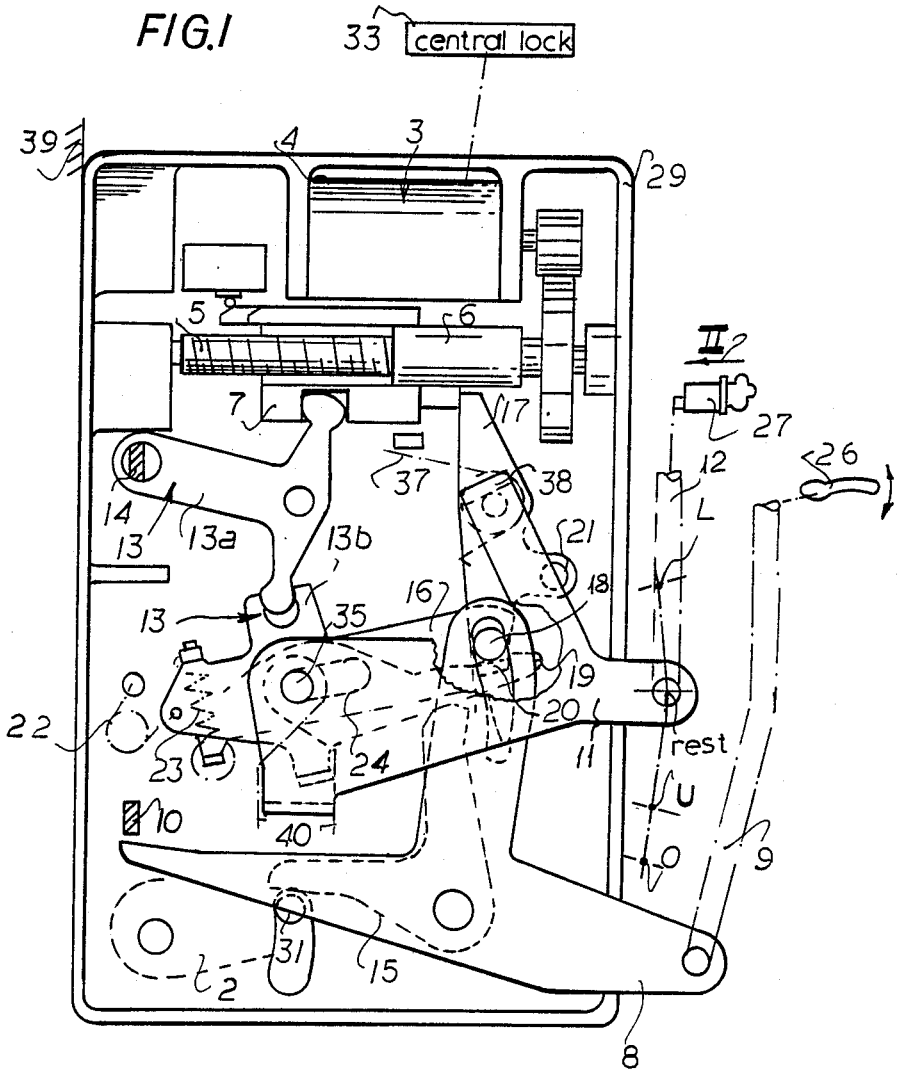
FIG. 1 is a vertical section through the latch according to this invention in the antitheft position.
Figure 1A:
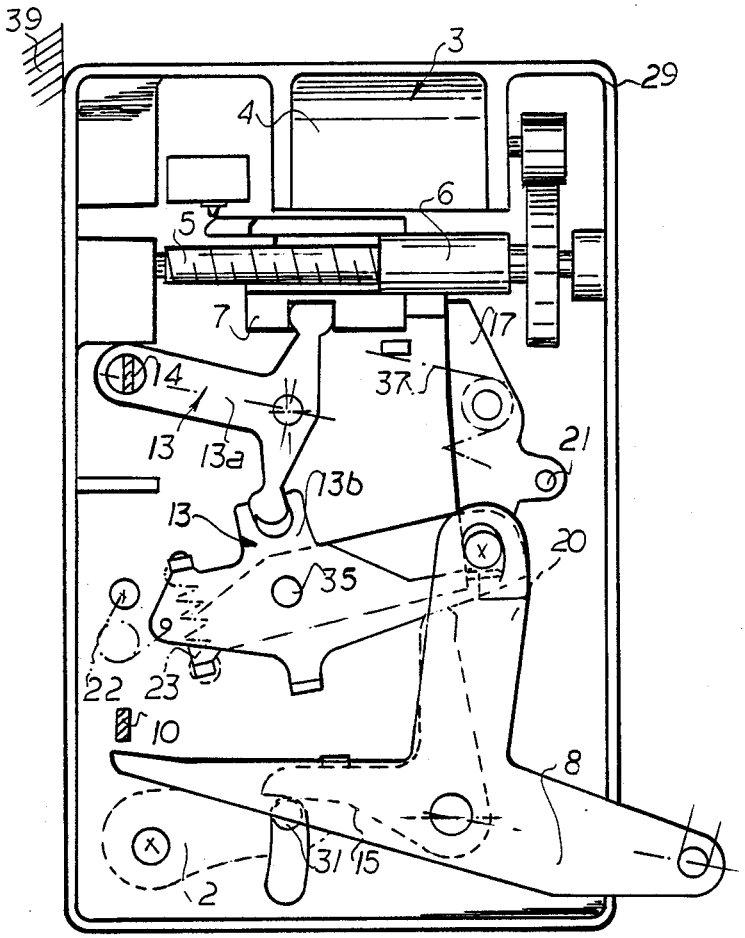
FIG. 1A is a view like FIG. 1 but with some parts removed for clarity of view.
Figure 2:
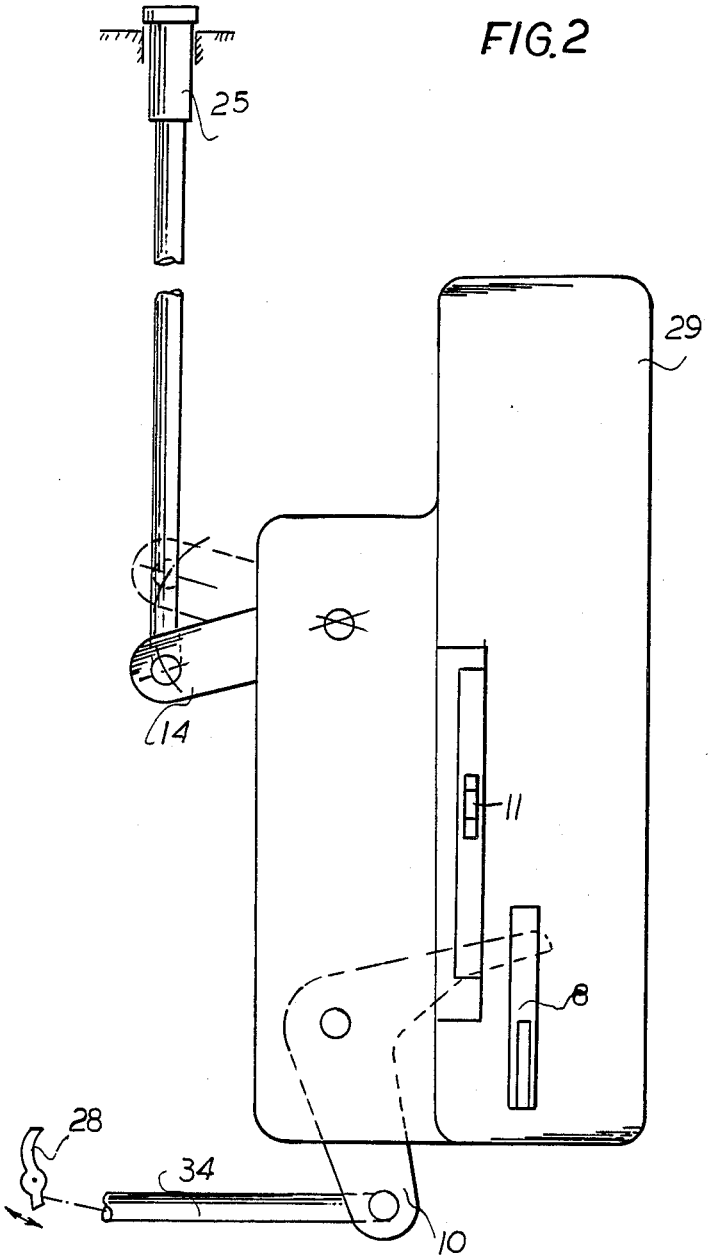
FIG. 2 is a side view taken in the direction of arrow II of FIG. 1.

As seen in FIGS. 1, 1A, 2, and 5, a motor-vehicle door latch has a housing 29 normally mounted on a door edge shown schematically at 39 and formed with a cutout 32 (FIG. 5) into which a bolt 30 projecting from the respective door post can engage. A pivotal fork 1 can engage over this bolt 30 to lock it in place in the cutout 32 and a latch pawl 31 is pressed by a spring 36 to normally engage this fork 1 and hold it in the locking position.

The latch has a servoactuator, here an electric motor 3, that can be operated by a central lock system shown schematically at 33. This motor 3 operates a threaded spindle 5 carrying via a nonlocking screwthread a nut 6 engageable with a latch-operating slider 7. The connection between the motor 3 and nut 6 is such that the nut 6 can be pushed along the spindle 5 even when same is not rotating. An inside operating lever 8 is pivoted on the housing 29 and connected via a rod 9 to an inside door handle 26 and an outside locking lever 10 is connected via a rod 34 (FIG. 2) to an outside door handle 28. An outside locking lever 11 movable between a lock position L, a rest position R, an unlock position U, and an override position 0 is connected via a rod 12 to a cylinder 27 operable from outside the vehicle door 39 and an inside locking lever system 13 comprised of two levers **13*a* and 13*b* is connected via another lever 14 (FIG. 2) to an inside door-locking button 25. A torque spring 40 carried by the lever 11 can engage a part of the lever 13*b* as described below. An actuating lever 15 has one arm engageable with a pin 31 on the pawl 2 to release the fork 1 and another arm engageable by a pin 18 carried on a link 16 mounted via a slot 24 on a pin 35 in the housing 20. The pin 18 engages through a slot 19 formed in the lever 8 and can either be aligned with the other arm of the lever 15 so that pivoting of the lever 8 operates the lever 15 and opens the latch, or can be out of alignment with the other arm of the lever 15**.

Thus in the normal unlocked position of the door the pin 18 is at the bottom of the slot 19 and an upward pull on the rod 9 or a downward push from the lever 10 will rotate the lever 8 counterclockwise as shown in FIG. 1. The pin 18 will engage the upper arm of the lever 15 and couple the lever 15 to the lever 8 for joint counterclockwise rotation and the pawl 2 will be pushed down, releasing the fork 1. During such counterclockwise pivoting the entire link 16 will be shifted to the left by sliding of the pin 35 along the slot 24. The return spring 36 (FIG. 5) will return the elements 8, 15, and 16 to the FIG. 1 position when neither of the handles 26 or 28 is actuated, although of course it is standard to provide other return springs also.

Figure 3:
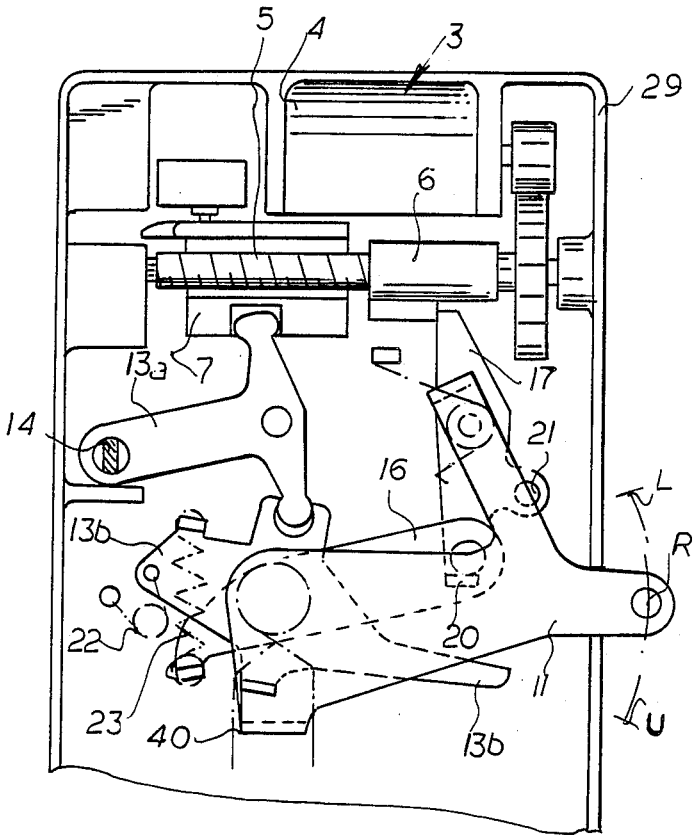
FIG. 3 is a vertical section like FIG. 1 through a portion of the latch but with the latch in the antitheft position with the inside latch button actuated.

The latch is locked by lifting the rod 12 with the lock cylinder 27 or depressing the button 25. Lifting the rod 12 as seen in FIG. 3 rotates the lever 11 counterclockwise and entrains the lever **13*b* by means of the spring 40 to raise the link 16 and lift the pin 18 past the end of the other arm of the lever 15. This action also pulls down the button 25. Similarly, depressing the button 25 raises the lever 14 which engages the first lever 13*a* of the linkage 13, pivoting it clockwise so that it engages and pivots the second lever 13*b* of the linkage 13 counterclockwise, also raising the link 16 and lifting the pin 18 past the end of the lever 15. The levers 13*b* and 16 are connected together by a spring 23 that forms a resilient coupling between these two levers like that formed by the spring 40 between the levers 11 and 13*b* and a toggle spring 22 of different strength urges the lever 13*b* into either of the two end positions shown in FIGS. 1 and 3. The actuator 3 can also be operated to push over the slide 7 and operate the first lever 13*a* of the inside door lock button 25**.

According to this invention an antitheft lever 17 pivoted on the housing 29 has one end pressed by a biasing spring 37 into engagement with the spindle nut 6 and an opposite end that is turned up at 20 and that can engage under the pin 18. In addition this lever 17 is provided with an abutment pin 21 that can itself be engaged by a turned over end 38 of the locking lever 11. As shown in FIG. 1 it is therefore possible by rotation of the spindle 5 to screw over the nut 6 and rotate this lever 17 clockwise until the end 20 comes under the pin 18, it being noted that during the first part of such stroke of the nut 6 the latch will be locked by action on the lever **13*a* and the pin 18 will be lifted to a position above the turned-in end 20. In the antitheft position counterclockwise pivoting of the lever 8 either by means of the handle 26 or 28 will not be transmitted to the lever 15 to unlock the door because the pin 18 will not be able to engage the lever 15. Similarly in the antitheft position displacement of the lever 11 into the unlock position U will merely tension the spring 40. Thus if the cylinder 27** is set up so that only a specially bitted key can move it into the override position O, a person not equipped with this key cannot unlock the door once the lock is in the antitheft position.

In addition in this antitheft position as shown in FIG. 3 even if the inside button 25 is forcibly pulled up the resultant clockwise pivoting of the lever **13*b* will not pivot the link 16 downward because the pin 18 will remain hooked over the lever end 20. Thus even though the spring 23 would normally seek to pull it down with the lever 13***b* the only effect of the clockwise pivoting of the lever 13*b* will be in tensioning the spring 40. The slide 7 can be moved in this position thanks to the non-binding nature of the connection to the spindle 5. Thus in this antitheft position the inside latch button 25 is ineffective. According to this invention when the spring 23 is weaker than the spring 22 any such attempt to open the door by pulling up the button 25 will leave this button 25 in the up position. Alternately the spring 23 could be stronger, in which case the button 25 would snap back down when released.

Figure 4:
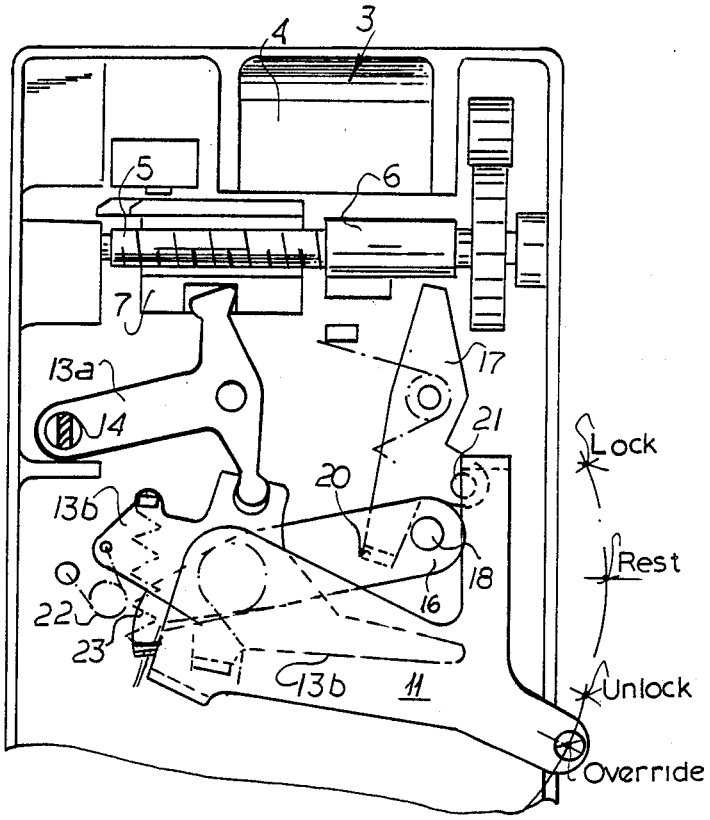
FIG. 4 is a vertical section like FIG. 1 through a portion of the latch but with the latch in the override position.
Figure 5:
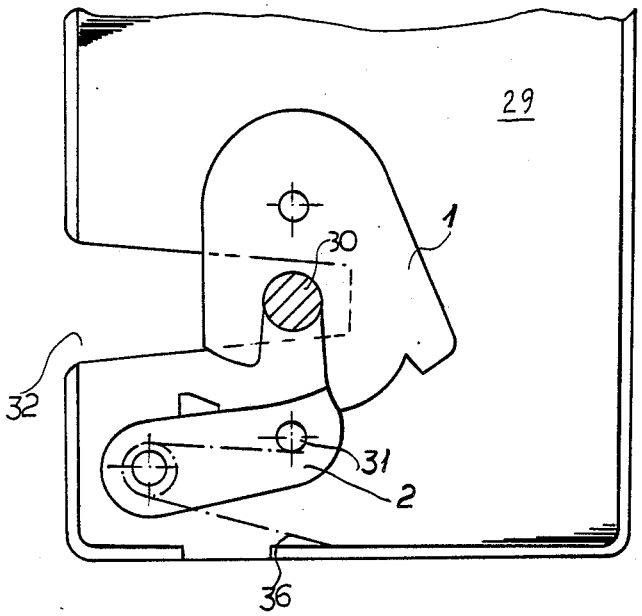
FIG. 5 is another section through the latch, but at a plane offset from that of FIGS. 1 through 4.

Although clearly the antitheft position can be canceled by reversing the motor 4 and pulling the nut 6 to the left, in accordance with a further feature of the invention it is possible to release the latch from the antitheft position manually. This is done by actuating the outside lock 27 so that the lever 11 is pushed down below the unlock position U to an override position O. On movement from the position U as seen in FIG. 4 to the position O the bentover end 38 of the lever 11 catches on the abutment pin 21 of the lever 17 and pivots it clockwise. This action pulls the end 20 clear of the pin 19 so that the door can be manually unlocked and opened.

We claim:

1. A motor-vehicle door latch for use on a vehicle door having inside and outside handles and inside and outside locking elements, the latch comprising:

a housing;

a latch fork pivotal on the housing and engageable in a locking position with a door bolt to retain same and lock the door;

inside and outside operating levers pivoted on the housing and connected to the respective handles;

inside and outside locking levers pivoted on the housing and connected to the respective locking elements;

an actuating lever operatively engageable with the fork to release same from the locking position;

a link coupled to the locking levers and displaceable thereby between a position coupling the outside operating lever to the actuating lever for displacement of the fork out of the locking position by actuation of the outside operating lever and a position decoupling the outside operating lever from the actuating lever, whereby in the decoupling position actuation of the outside operating lever will not unlock the door;

central actuating means including an actuator in the latch displaceable into an antitheft position;

an antitheft lever displaceable by the actuator in the antitheft position thereof; and mechanism connected between the antitheft lever, the inside levers, and the link for decoupling the inside operating and locking levers from the actuating lever in the antitheft position of the antitheft lever, whereby in the antitheft position actuation of the inside operating lever will not release the fork and actuation of the inside locking lever will not unlock the door.

2. The motor-vehicle door latch defined in claim 1 wherein the antitheft lever is provided with a formation engageable with the link to retain same in the decoupling position in the antitheft position of the antitheft lever.

3. The motor-vehicle door latch defined in claim 2 wherein the link includes a pin, the outside operating lever being formed with an elongated slot through which the pin projects, the formation of the antitheft lever being an abutment engageable with the pin.

4. The motor-vehicle door latch defined in claim 3 wherein the antitheft lever and outside locking lever are provided with interengageable override formations and the outside locking lever is displaceable into an override position engaging the override formations together and pulling the abutment of the antitheft lever out of engagement with the pin.

5. The motor-vehicle door latch defined in claim 3 wherein the inside locking lever has a pair of separately pivoted but interengaged parts, the latch further comprising a spring coupling one of the parts to the link for joint pivoting and a toggle spring connected between the housing and the one part to retain same in each of two end positions.

6. The motor-vehicle door latch defined in claim 5 wherein one of the springs is substantially stiffer than the other of the springs.

7. The motor-vehicle door latch defined in claim 1 wherein the actuator is a motor provided with a spindle in turn provided with a nut engaging the antitheft lever.

8. The motor-vehicle door latch defined in claim 1, further comprising a latch pawl connected between the actuating lever and the fork.

9. A motor-vehicle door latch for use on a vehicle door having inside and outside handles and inside and outside locking elements, the latch comprising:

a housing;

a latch fork pivotal on the housing and engageable in a locking position with a door bolt to retain same;

an operating lever pivoted on the housing and connected to the handles;

inside and outside locking levers pivoted on the housing and connected to the respective locking elements;

an actuating lever operatively engageable with a fork to release same from the locking position;

a link displaceable by the locking levers between a position coupling the operating lever to the actuating lever for displacement of the fork out of the locking position by actuation of the operating lever and a position decoupling the outside operating lever from the actuating lever, whereby in the decoupling position actuation of the outside operating lever will not unlock the door;

means connected between each of the locking levers and the link for displacing same between its positions by operation of either of the locking levers; and central actuating means including an actuator in the latch, and an antitheft lever displaceable by the actuator into an antitheft position and engageable therein with the link for retaining the link in the decoupling position regardless of actuation of the inside operating and locking levers, whereby in the antitheft position actuation of the inside operating lever will not release the fork and actuation of the inside locking lever will not unlock the door.

* * * * *